US012371075B2

(12) United States Patent
Zaech

(10) Patent No.: US 12,371,075 B2
(45) Date of Patent: Jul. 29, 2025

(54) ASSEMBLY FOR POSITIONING A WHEEL OF A RAIL VEHICLE

(71) Applicant: Siemens Mobility GmbH, Munich (DE)

(72) Inventor: Martin Zaech, Raubling (DE)

(73) Assignee: Siemens Mobility GmbH, Munich (DE)

( * ) Notice: Subject to any disclaimer, the term of this patent is extended or adjusted under 35 U.S.C. 154(b) by 672 days.

(21) Appl. No.: 17/769,819

(22) PCT Filed: Aug. 12, 2020

(86) PCT No.: PCT/EP2020/072557
§ 371 (c)(1),
(2) Date: Apr. 18, 2022

(87) PCT Pub. No.: WO2021/073795
PCT Pub. Date: Apr. 22, 2021

(65) Prior Publication Data

US 2022/0355835 A1 Nov. 10, 2022

(30) Foreign Application Priority Data

Oct. 18, 2019 (DE) ..... 10 2019 216 088.3

(51) Int. Cl.
*B61F 5/30* (2006.01)
*B61F 5/32* (2006.01)

(52) U.S. Cl.
CPC ..... *B61F 5/30* (2013.01); *B61F 5/32* (2013.01); *B61F 5/325* (2013.01)

(58) Field of Classification Search
CPC ..... B61F 5/00; B61F 5/30; B61F 5/32; B61F 5/325; B61F 5/38; B61F 5/52
See application file for complete search history.

(56) References Cited

U.S. PATENT DOCUMENTS

| | | | | |
|---|---|---|---|---|
| 2,152,032 | A * | 3/1939 | De Los Rice | B61F 5/32 105/224.06 |
| 7,234,723 | B2 * | 6/2007 | Sellers | B60G 9/00 280/146 |
| 8,136,455 | B2 * | 3/2012 | Rodet | B61F 5/305 105/197.05 |
| 9,592,840 | B2 * | 3/2017 | Okumura | B61F 5/302 |
| 9,718,484 | B2 * | 8/2017 | Zanutti | B61F 5/30 |

(Continued)

FOREIGN PATENT DOCUMENTS

| | | |
|---|---|---|
| CN | 101612944 A | 12/2009 |
| CN | 101678841 A | 3/2010 |

(Continued)

*Primary Examiner* — S. Joseph Morano
*Assistant Examiner* — Cheng Lin
(74) *Attorney, Agent, or Firm* — Laurence A. Greenberg; Werner H. Stemer; Ralph E. Locher

(57) ABSTRACT

An assembly for positioning a wheel of a rail vehicle. The wheel is supported on a wheel shaft and there is provided a swing arm and a frame of a bogie of the rail vehicle. The swing arm has a first end that is connected to the frame of the bogie in a rotationally mounted manner. The swing arm has a second end that is connected to the wheel shaft. The swing arm has a fixed, but detachable, connection between the first end and the second end which allows for the swing arm to be mechanically divided into two.

4 Claims, 2 Drawing Sheets

(56) References Cited

U.S. PATENT DOCUMENTS

| | | | | |
|---|---|---|---|---|
| 2010/0083866 | A1* | 4/2010 | Rodet | B61F 3/04 105/34.1 |
| 2014/0158015 | A1* | 6/2014 | Shimokawa | B61F 5/30 105/165 |
| 2019/0009798 | A1* | 1/2019 | Taga | B61F 5/30 |

FOREIGN PATENT DOCUMENTS

| | | | |
|---|---|---|---|
| CN | 202413824 | U | 9/2012 |
| CN | 103448743 | A | 12/2013 |
| CN | 103702889 | A | 4/2014 |
| DE | 102011110090 | A1 | 2/2013 |
| EP | 0247389 | A2 | 12/1987 |
| EP | 0397291 | A2 | 11/1990 |
| EP | 0571961 | A1 | 12/1993 |
| EP | 2557015 | A2 | 2/2013 |
| GB | 780783 | A | 8/1957 |
| JP | 2017067096 | A | 4/2017 |

* cited by examiner

ASSEMBLY FOR POSITIONING A WHEEL OF A RAIL VEHICLE

FIELD AND BACKGROUND OF THE INVENTION

The invention relates to an arrangement for positioning a wheel of a rail vehicle.

In a rail vehicle, the wheel is often part of a wheel set. The wheel set generally comprises in this instance a wheel set shaft and two track wheels. The wheels are secured to the wheel set shaft and are carried by the wheel set shaft.

The wheel set transmits the weight and the dynamic loads of the vehicle to the rails, guides the vehicle in the track and transmits drive and brake forces of the vehicle to the rails.

The wheel set in turn is often part of a bogie, wherein the wheel set is supported in a frame which can be rotated with respect to the body.

In comparison with vehicles having axles which are fitted rigidly to the bodies, vehicles having bogies may travel on tighter bends since the frame can turn out with respect to the body and the wheels can thereby run at a smaller angle on the rail. Bogies further improve the quiet running since they transmit impacts in the vertical and transverse direction in a reduced manner to the body.

In specific construction variants, the wheels are retained in their position in the frame below the rail vehicle by means of a so-called swing arm. To this end, the swing arm is secured to a bogie in a manner rotatably supported at a first end. At a second end of the bogie, the swing arm is connected to the wheel set shaft.

FIG. 4 shows using a rail vehicle cut-out such a swing arm SCHW having a wheel set shaft RSW and a track wheel LFR according to the prior art.

As set out above, the swing arm SCHW is secured to a frame RAH of the bogie in a manner rotatably supported at a first end SCHWE1.

At a second end SCHWE2, the swing arm SCHW is connected to the wheel set shaft RSW in order to fix it in position.

The swing arm SCHW is connected to the frame RAH (not illustrated in this instance) in a manner additionally cushioned in a vertical direction.

If a wheel set having large track wheels is secured or positioned by means of swing arms, this results in problems with the disassembly of the wheel set during service and maintenance operations. If the swing arm is released from the bogie, the swing arm falls abruptly as a result of the high inherent weight until it rests on the ground.

If active chassis elements or mechanically sensitive chassis elements are integrated in the bearing of the swing arm, the disassembly of the swing arm is also thereby made more difficult—the disassembly has to be carried out with the required care which is time-intensive and intensive in terms of operators.

SUMMARY OF THE INVENTION

An object of the present invention is therefore to provide an improved wheel positioning by means of which the disadvantages mentioned above are overcome.

This object is achieved by the features as claimed. Advantageous developments are set out in the dependent claims.

The invention relates to an arrangement for positioning a wheel of a rail vehicle having a wheel, having a swing arm and having a frame of a bogie of the rail vehicle. The wheel is in this instance carried by a wheel shaft.

The wheel in question is in this instance either a wheel which is not driven and which is also referred to as a track wheel, or alternatively an actively driven wheel.

The swing arm has a first end which is connected in a rotatably supported manner to the frame of the bogie. The swing arm has a second end which is connected to the wheel shaft.

The swing arm has between the first end and the second end a fixed but releasable connection which enables the swing arm to be mechanically divided in two.

In a preferred development, the wheel is part of a wheel set, wherein the wheel set has a wheel set shaft which carries two wheels or track wheels of the rail vehicle.

In a preferred embodiment, the fixed but releasable connection is configured as a screw connection or as a bolt connection.

In a preferred embodiment, the fixed but releasable connection has two flange plates which are part of the screw connection or the bolt connection.

In a preferred development, the swing arm is configured in the region of the fixed but releasable connection thereof in a substantially rotationally symmetrical manner, that is to say, with respect to the axle of the wheel set. During disassembly, a swing arm portion is thereby prevented from tilting.

Preferably, the fixed but releasable connection is arranged almost centrally in the swing arm which is constructed in a longitudinal manner.

As a result of the present invention, a simpler disassembly or maintenance of wheels or wheel sets of a rail vehicle is enabled.

As a result of the present invention, the effectiveness during production and maintenance is increased.

As a result of the present invention, costs are saved during production and maintenance.

As a result of the present invention, contamination and corrosion on the swing arm bearing are reduced or prevented by means of facilitated maintenance operations.

BRIEF DESCRIPTION OF THE FIGURES

The present invention is explained in greater detail below by way of example with reference to drawings, in which.

DETAILED DESCRIPTION OF THE INVENTION

Figure 1:
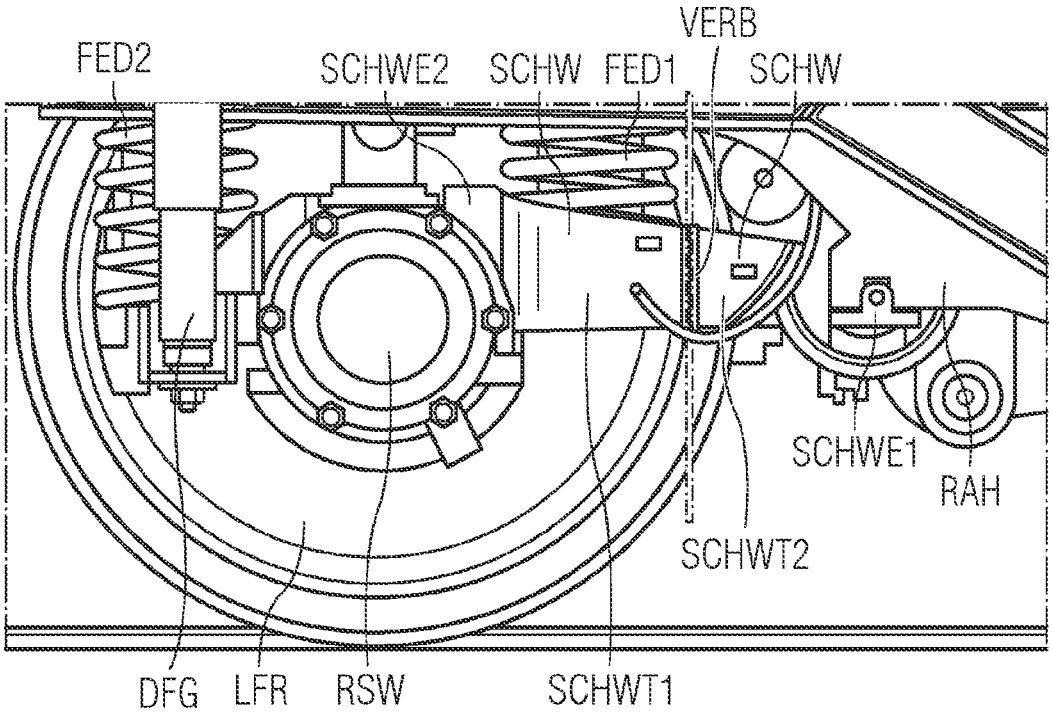
FIG. 1 shows an embodiment of the arrangement according to the invention.

FIG. 1 shows an embodiment of the arrangement according to the invention for positioning track wheels LFR of a wheel set of a rail vehicle which is not illustrated in greater detail here.

A wheel set shaft RSW carries two track wheels LFR of the rail vehicle.

A swing arm SCHW has a first end SCHWE1 which is connected in a rotatably supported manner to the frame RAH of a rail vehicle bogie.

The swing arm SCHW has a second end SCHWE2 which is connected to the wheel set shaft RSW.

The swing arm SCHW has between the first end SCHWE1 and the second end SCHWE2 a fixed but releasable connection VERB which enables a mechanical division of the swing arm SCHW into two portions SCHWT1, SCHWT2.

The fixed but releasable connection VERB is in this instance preferably configured as a screw connection, wherein, for example, two flange plates are part of the screw connection, via which the threaded joint is carried out.

FIG. 1 further shows two springs FED1, FED2, via which a resilient support which is carried out in a vertical direction is produced.

Via a damper DFG, movements which are carried out in a vertical direction are damped.

Figure 2:
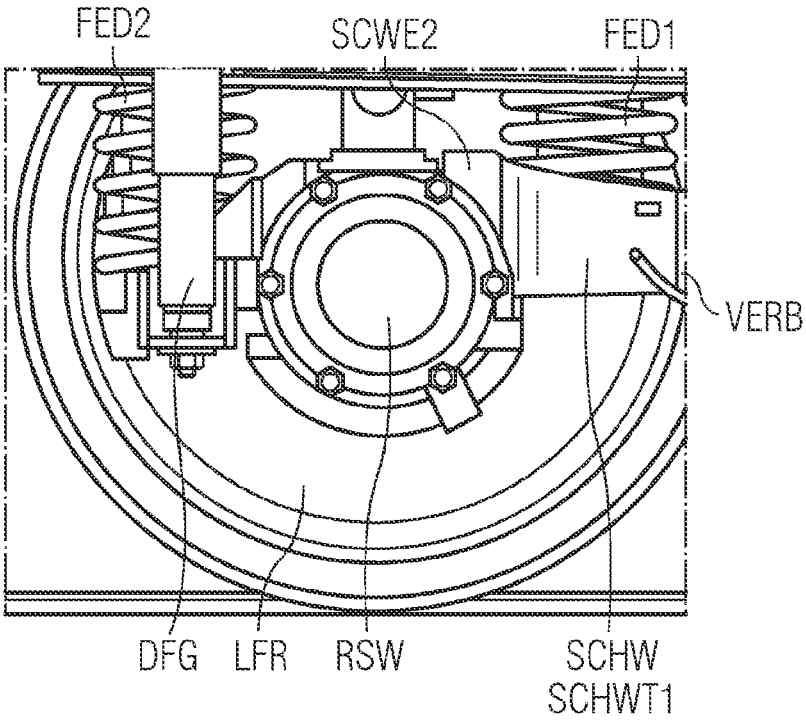
FIG. 2 shows with respect to FIG. 1 a portion of the swing arm remaining on the wheel set with a separated connection.

FIG. 2 shows with respect to FIG. 1 the portion SCHWT1 of the swing arm SCHW remaining on the wheel set with a separated connection VERB.

This portion SCHWT1 of the swing arm SCHW is preferably configured in a substantially rotationally symmetrical manner, preferably with respect to the axle of the wheel set. The handling of the wheel set which has been disassembled is thereby facilitated, tilting of a swing arm portion is prevented by the almost central division of the swing arm shown here.

Figure 3:
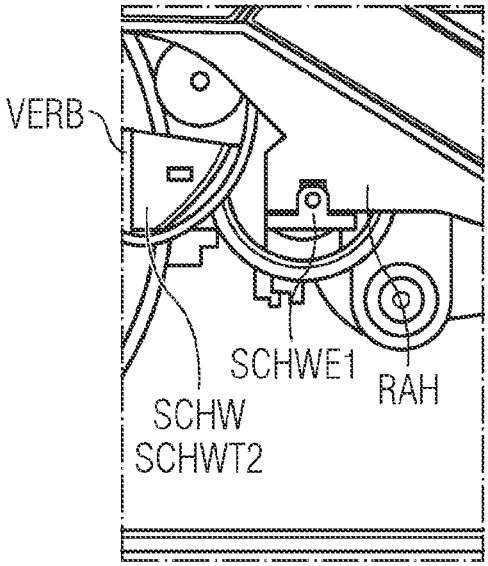
FIG. 3 shows with respect to FIG. 1 a portion of the swing arm remaining on the bogie with a separated connection.
Figure 4:
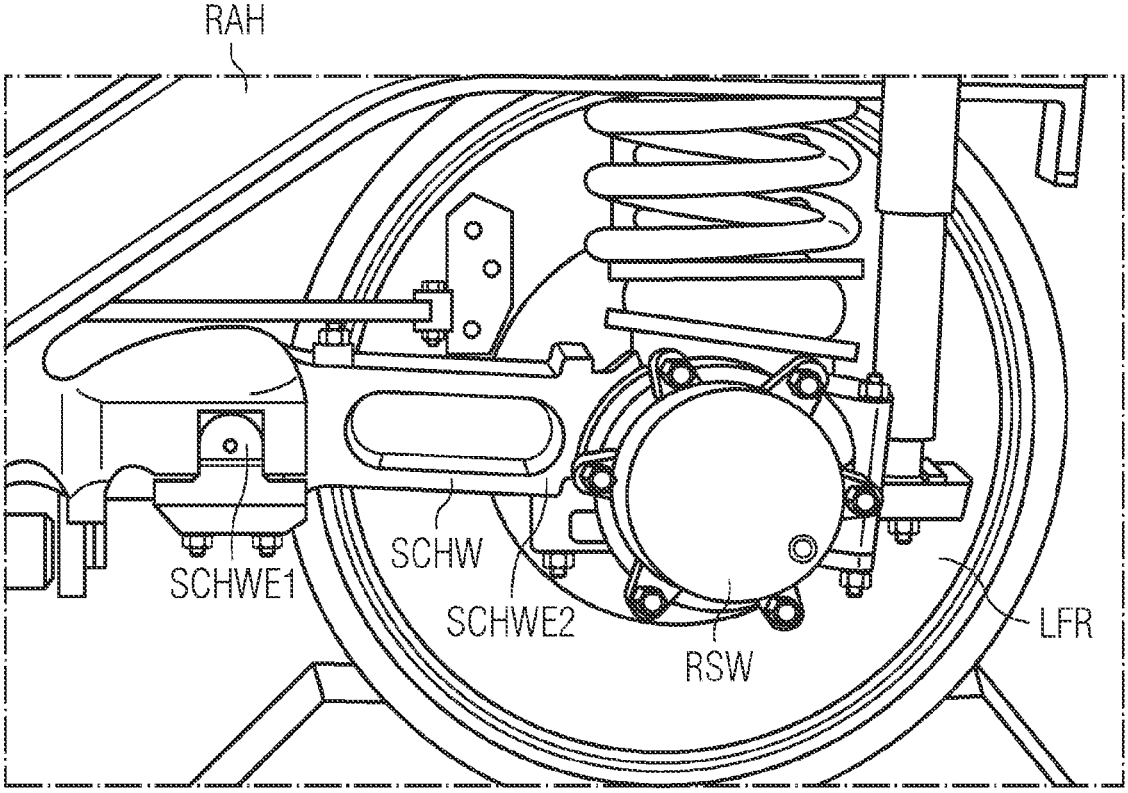
FIG. 4 shows the cut-out of a rail vehicle described above in the introduction according to the prior art.

FIG. 3 shows with respect to FIG. 1 the portion SCHWT2 of the swing arm SCHW remaining on the bogie with a separated connection VERB.

The connection VERB is preferably selected in terms of its position in such a manner that the portion SCHWT2 which is difficult to assemble remains on the bogie frame RAH.

The invention claimed is:

1. An arrangement for positioning a wheel of a rail vehicle, comprising:

a frame of a bogie of the rail vehicle;

a wheel shaft carrying the wheel;

a swing arm having a first end rotatably mounted to said frame of the bogie;

said swing arm having a second end connected to said wheel shaft; and said swing arm having a fixed but nondestructively releasable connection between said first end and said second end, said releasable connection enabling said swing arm to be mechanically divided into two parts, and said two parts of said swing arm being directly and rigidly connected at said releasable connection.

2. The arrangement according to claim 1, wherein said fixed but releasable connection is a screw connection or a bolt connection.

3. The arrangement according to claim 2, wherein said fixed but releasable connection has two flange plates which are part of said screw connection or said bolt connection.

4. The arrangement according to claim 1, wherein said wheel forms part of a wheel set, said wheel set having a wheel set shaft carrying two wheels or track wheels of the rail vehicle.

* * * * *